US007003823B1

(12) United States Patent
Reed et al.

(10) Patent No.: US 7,003,823 B1
(45) Date of Patent: Feb. 28, 2006

(54) CRIB SAFETY NET

(75) Inventors: Philip A. Reed, Virginia Beach, VA (US); Montessa L. Reed, Virginia Beach, VA (US)

(73) Assignee: Crib Saftey Net, LLC, Virginia Beach, VA (US)

( * ) Notice: Subject to any disclaimer, the term of this patent is extended or adjusted under 35 U.S.C. 154(b) by 14 days.

(21) Appl. No.: 11/019,878

(22) Filed: Dec. 22, 2004

(51) Int. Cl.
*A47D 7/00* (2006.01)

(52) U.S. Cl. ..... 5/424; 5/946; 5/416

(58) Field of Classification Search ..... 5/47, 5/424, 414, 416, 93.1, 946
See application file for complete search history.

(56) References Cited

U.S. PATENT DOCUMENTS

| | | | | |
|---|---|---|---|---|
| 2,566,790 | A | 9/1951 | Bloomfield | |
| 2,586,247 | A | 2/1952 | Mover | |
| 2,881,778 | A | 4/1959 | Goldman | |
| 3,165,760 | A | 1/1965 | Abajian | |
| 4,370,765 | A | 2/1983 | Webber | |
| 4,641,387 | A | 2/1987 | Bondy et al. | |
| 4,862,534 | A | 9/1989 | Gomez-Marcial | |
| 5,010,611 | A | 4/1991 | Mallett | |
| D365,957 | S | 1/1996 | Ferrari | |
| 5,533,715 | A | 7/1996 | Dandrea | |
| 5,577,276 | A | 11/1996 | Nichols et al. | |
| 5,727,265 | A | 3/1998 | Ziegler et al. | |
| 5,881,408 | A | 3/1999 | Bashista et al. | |
| 5,926,873 | A | 7/1999 | Fountain | |
| 6,067,676 | A | 5/2000 | Carnahan et al. | |
| 6,170,101 | B1 | 1/2001 | McCloud | |
| D444,329 | S | 7/2001 | Newman | |
| 6,263,894 | B1 | 7/2001 | LaMantia | |
| 6,401,281 | B1 * | 6/2002 | Younge | 5/663 |
| 6,421,857 | B1 | 7/2002 | Whatman et al. | |
| 6,434,767 | B1 | 8/2002 | Welsh, Jr. | |
| 6,510,570 | B1 | 1/2003 | Hartenstine et al. | |
| 6,550,083 | B1 * | 4/2003 | LaMantia | 5/97 |

OTHER PUBLICATIONS

One Step Ahead; Spring Preview 2004 Catalog; p. 28.

* cited by examiner

*Primary Examiner*—Heather Shackelford
*Assistant Examiner*—Fredrick Conley
(74) *Attorney, Agent, or Firm*—Bowman Green Hampton & Kelly, PLLC

(57) ABSTRACT

A crib safety net, which is securable to an open-top interior space of a crib, comprising one or more side panels coupled relative to each other, wherein the side panels form vertical panels of the crib safety net, wherein the side panels are capable of substantially covering the side walls of the open-top crib interior space, and wherein the side panels each include a top edge portion, and a bottom panel substantially perpendicularly coupled relative to the side panels, wherein the bottom panel forms a horizontal panel of the crib safety net, wherein the bottom panel is capable of substantially covering the support surface of the open-top crib interior space, and wherein the bottom panel is capable of being at least partially covered by a crib mattress.

21 Claims, 7 Drawing Sheets

CRIB SAFETY NET

BACKGROUND OF THE INVENTION

1. Field of the Invention

This invention relates generally to infant and baby crib products. In particular, the present invention relates to infant and baby crib safety nets.

2. Description of Related Art

Infant and baby cribs are traditionally designed with two side walls and two end walls that are made up of slats and/or panels connected together via top and bottom rails. The side walls and end walls are generally joined at the corners by legs that begin proximate the top rail and extend below the bottom rails. Generally, a crib mattress rests on a spring-supported surface that is fastened to the bottom rails.

At least a portion of one of the side walls of the crib can typically drop down or swing out to provide easier access to and from the crib.

This conventional crib design is rigid and is typically sufficient to keep an infant placed within the crib from rolling out, while allowing for sufficient air flow to the infant.

SUMMARY OF THE INVENTION

Unfortunately, because of the current design and construction of baby or infant cribs, infants can roll into hard surfaces or have limbs become stuck in the openings. Additionally, top rails are hard on teeth and could possibly splinter if infants teeth on the rails.

Designs that were created to address some of these safety issues have shortcomings. For example, traditional bumper pads that tie to crib slats offer protection from hard surfaces but can allow infants to become entangled and can also be used as a step by toddlers.

This invention relates to protective crib liners. More specifically, this invention is drawn to a net that protects children from becoming entangled in the slats or hardware of a crib, from rolling into hard surfaces, and from self-injury inflicted by teething on the top rails.

In an illustrative, non-limiting embodiment of this invention, the crib safety net comprises a lining for a baby, infant, or toddler crib that comprises end and side panels sewn together and attached to a bottom panel. The top of the crib safety net may be attached to the crib rails via, for example, hook and loop fasteners. The bottom of the crib safety net is held in place by the crib mattress. The seamless design of the crib safety net protects children from becoming wedged in crib slats or hardware.

In an illustrative, non-limiting embodiment of this invention, the crib safety net also includes a sleeve or compartment around the perimeter, above the mattress, which allows insertion of a bumper pad. By inserting a bumper pad in a sleeve around the perimeter of the crib safety net, the bumper pad is kept taught and in place and the possibility of an infant becoming entanglement in the bumper pad is eliminated. Likewise, the climbing dangers associated with traditional bumper pads are reduced as the crib safety net also reduces the potential for a toddler to use the bumper pads as a step.

Finally, the crib safety net also includes a pad sewn or formed around the top of the crib safety net that attaches, via, for example, hook and loop fasteners, to the rails. This feature helps protect children when teething and works with crib designs that have side walls, which slide or flip open.

Accordingly, this invention provides a crib safety net, which is capable of preventing infants from having their limbs entangled in crib slats or hardware.

This invention separately provides a crib safety net, which provides a sleeve around a perimeter of the safety net for the insertion of a bumper pad.

This invention separately provides a crib safety net, which includes a pad coupled along the top perimeter of the entire net.

This invention separately provides a crib safety net, which reduces the potential of injury to a baby, infant, or toddler in the crib.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF AN EXEMPLARY EMBODIMENT

For simplicity and clarification, the design factors and operating principles of the crib safety net according to this invention are explained with reference to various exemplary embodiments of a crib safety net according to this invention. The basic explanation of the design factors and operating principles of the crib safety net is applicable for the understanding, design, and operation of the crib safety net of this invention.

Figure 1:
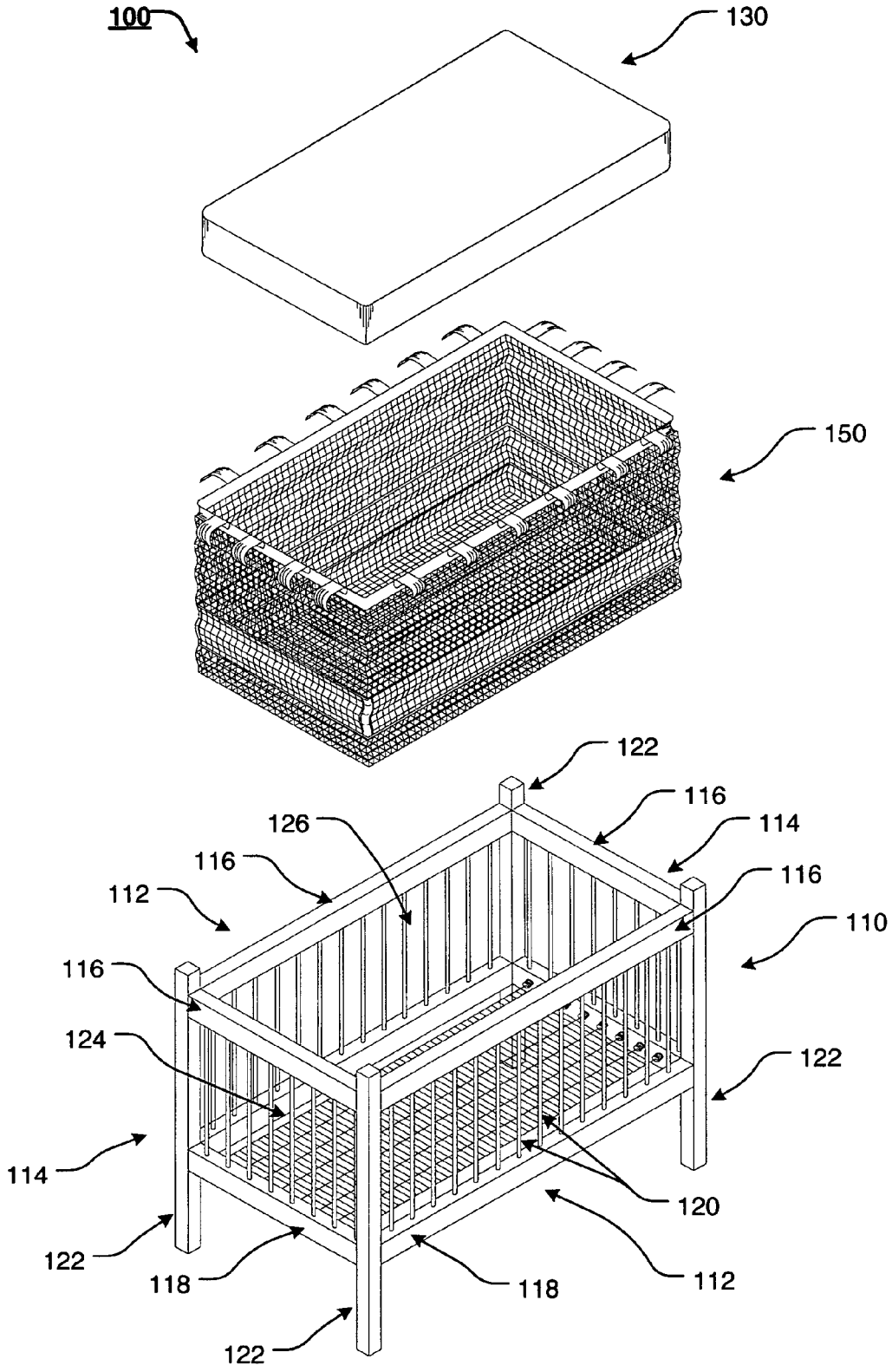
FIG. 1 shows an exploded perspective view of an exemplary embodiment of a crib safety net as the crib safety net fits in relation to an exemplary infant crib and an exemplary crib mattress, according to this invention.
Figure 2:
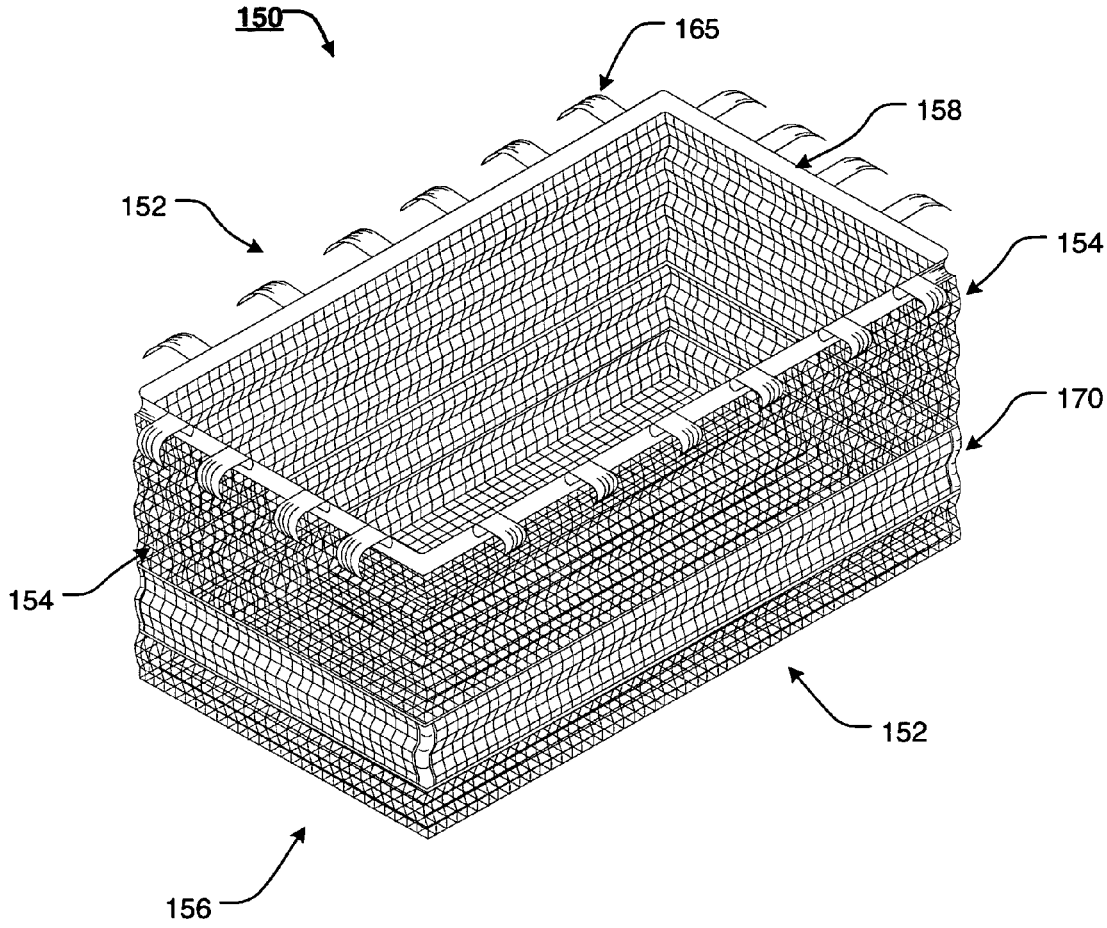
FIG. 2 shows a more detailed perspective view of an exemplary embodiment of the crib safety net, according to this invention.

FIG. 1 shows an exploded perspective view of an exemplary embodiment of a crib safety net 150 as the crib safety net 150 fits in relation to an exemplary infant crib 110 and an exemplary crib mattress 130, according to this invention. FIG. 2 shows a more detailed perspective view of the exemplary embodiment of the crib safety net 150, according to this invention.

As shown in FIG. 1, the infant crib 110 comprises at least some of two opposing side walls 112 and two opposing end walls 114.

Each side wall comprises a top rail 116, a bottom rail 118, and a plurality of spaced apart panels, bars, or slats 120 held between the top rail 116 and the bottom rail 118. The side walls 112 and the end walls 114 are maintained in place by four legs 122.

A support surface 124 is suspended within the crib 110 and typically supports a crib mattress 130.

The combination of side walls 112, end walls 114, and support surface 124 create an open-top crib interior space 126.

It should be appreciated that such cribs are well known in the art.

As also shown in FIG. 1, and in greater detail in FIG. 2, the crib safety net 150 comprises two opposing side panels 152, two opposing end panels 154, and a bottom panel 156. In various exemplary embodiments, the two opposing side panels 152 and two opposing end panels 154 comprise individual panels that are sewn, fused, attached, or otherwise coupled to form vertical panels of the crib safety net 150. In various exemplary embodiments, the two opposing side panels 152 and two opposing end panels 154 may be formed of one, substantially continuous loop of material, which forms the vertical panels of the crib safety net 150.

The vertical panels of the crib safety net 150 are sewn, fused, attached, or otherwise coupled to the bottom panel 156 to form the crib safety net 150.

In various exemplary embodiments, the two opposing side panels 152, the two opposing end panels 154, and the bottom panel 156 may be formed of one, substantially continuous portion of fabric or material, which forms the crib safety net 150.

The combination of the opposing side panels 152, the opposing end panels 154, and the bottom panel 156 create an open-top crib safety net 150.

In various exemplary embodiments, the two opposing side panels 152 and the two opposing end panels 154 are designed to have approximately the same dimensions as corresponding side and end walls of the interior of a standard crib. Likewise, the bottom panel 156 is designed to have approximately the same dimensions as corresponding mattress support surface of a standard crib.

In this manner, the two opposing side panels 152 and the two opposing end panels 154 are capable of substantially covering the two opposing side walls 112 and the two opposing end walls 114 of the open-top crib interior space 126 and the bottom panel 156 is capable of substantially covering the support surface 124 of the open-top crib interior space 126.

In various exemplary, non-limiting embodiments of the crib safety net 150, each of the opposing side panels 152 and the opposing end panels 154 includes a top edge portion 158. The top edge portion 158 comprises an elastic, stretchable, or non-elastic, non-stretchable material and is of a sufficient dimension to at least partially cover the top rail 116 of the opposing side walls 112 and opposing end walls 114 of the exemplary crib 110.

In various exemplary embodiments, the top edge portion 158 includes a padded portion 160 that is permanently or removably attached to the top edge portion 158. The padded portion 160 may comprise a material, such as, for example, foam, which will provide padding qualities to the top edge portion 158.

In various exemplary embodiments, the side panels and/or bottom panel comprise an open mesh weave having a mesh size, which is capable of preventing a baby's arm, leg, hand, or possibly even finger from passing through the mesh while still providing sufficient air flow and allowing a caregiver to see the baby through the mesh material. In various exemplary embodiments, the side panels and/or bottom panel comprise a lightweight fabric or other material and may include mesh, netting, net material, woven fabrics, sheet fabrics, nylon, spandex, vinyl, Polyvinyl Chloride (PVC), neoprene, or the like. Additionally, the side panels may be made of any flexible and/or elastic material and may stretch. Alternatively, the side panels may be formed from multiple materials. The fabric may be water-resistant and durable enough to withstand the wear and tear associated with a crib safety net that is appropriate for use in a baby, infant, or toddler crib. In various exemplary embodiments, the side panels may include a cushion material.

It should be appreciated that the terms fabric and material are to be given their broadest meanings and that the particular fabric or material used to form the side panels are a design choice based on the desired appearance, wearability, and/or functionality of the crib safety net 150.

In various exemplary embodiments, the crib safety net 150 is removably positioned within the crib interior space 126 of the exemplary crib 110. The top edge portion 158 of each of the opposing side panels 152 and the opposing end panels 154 is secured along the rail 116 of the opposing side walls 112 and opposing end walls 114 of the exemplary crib 110 by means of a safety net attachment means 165. In various exemplary embodiments, the safety net attachment means 165 may comprise a hook and loop fastener, such as Velcro. It should be appreciated that, in various exemplary embodiments the safety net attachment means 165 may be secured along the rail 116 of the opposing side walls 112 and opposing end walls 114 of the exemplary crib 110 by one or more attachment means or releasable fasteners, such as, for example, male/female snap-release buckles, zippers, buttons, snaps, or other fastening, closure, or attachment means known by those skilled in the art. Alternatively, the crib safety net 150 may be removably fitted within the crib interior space 126 of the exemplary crib 110 without being secured along the rail 116 of the opposing side walls 112 and opposing end walls 114 of the exemplary crib 110.

The bottom panel 156 rests atop the support surface 124 and the crib mattress 130 is placed atop the bottom panel 156. Thus, the bottom panel 156 is maintained in place on the support surface 124 by the crib mattress 130.

In various exemplary embodiments, the crib safety net 150 further comprises a compartment 170 constructed so as to allow a conventional bumper pad to be held within the compartment 170. The compartment 170 is located around the perimeter of the crib safety net 150, in a position that is above the crib mattress 130. At least one opening is formed in the compartment 170, for example, in the corners of the compartment 170, such that a bumper pad may be inserted and/or removed from the compartment 170.

In this manner, a bumper pad may be held or maintained in a desired position within the crib safety net 150 and, ultimately, the crib interior space 126 of the exemplary crib 110.

At least a portion of the compartment 170 may be formed of the same material as the other portions of the crib safety net 150 or at least a portion of the compartment 170 may be formed of a material that is different from the remaining portions of the crib safety net 150.

Figure 3:
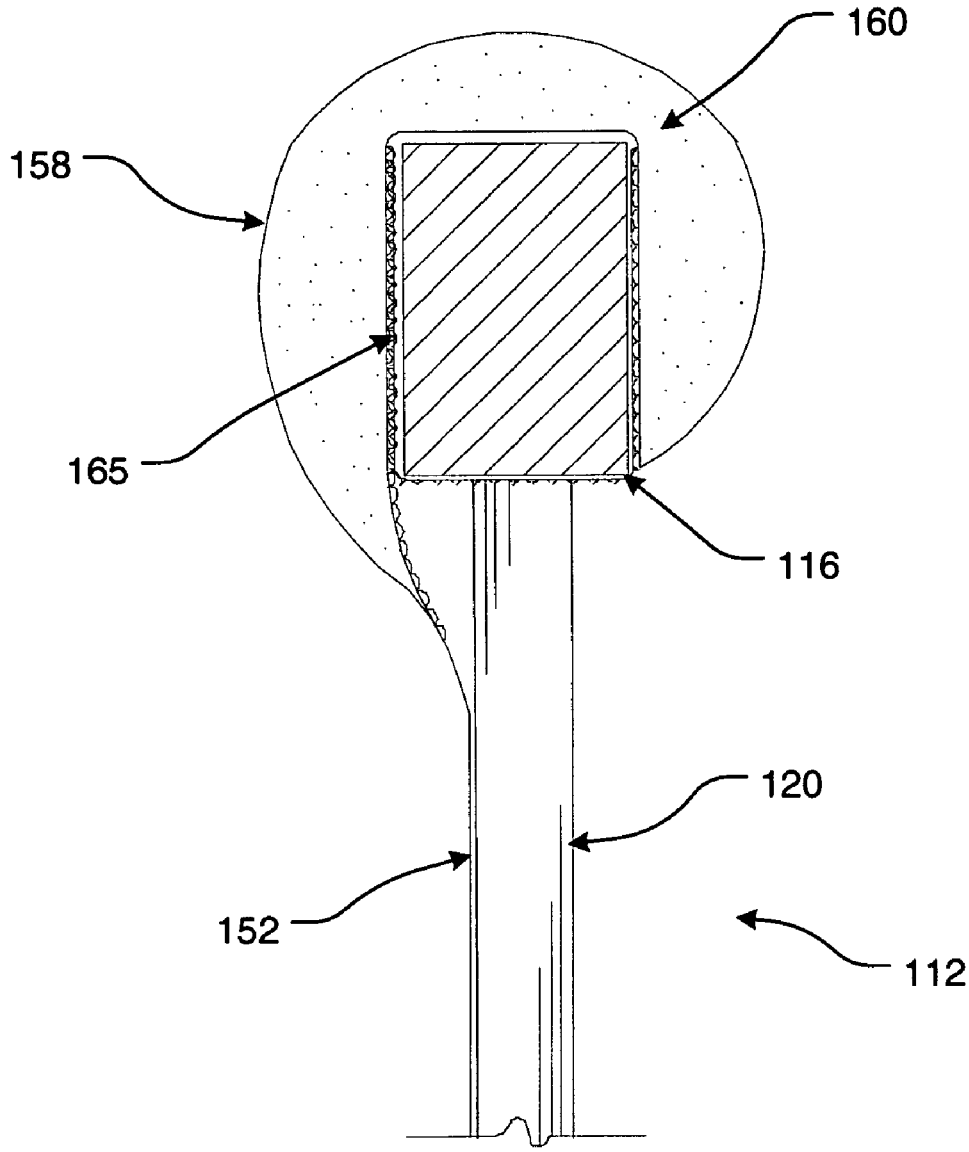
FIG. 3 shows a cross-sectional view of an exemplary embodiment of the crib safety net coupled to a crib rail via safety net attachment means, according to this invention.

FIG. 3 shows a cross-sectional view of an exemplary embodiment of the crib safety net 150 coupled to a crib rail 116 via the safety net attachment means 165, according to this invention. As shown in FIG. 3, the safety net attachment means comprise hook and loop fasteners, which secure the crib safety net 150, and, more specifically, the top edge portion 158 to the crib rail 116.

In this exemplary embodiment, one side of the hook and loop fastener is sewn along the entire perimeter on the underside of the top edge portion 158. The other side of the hook and loop fastener will be in the form of movable strips. The movable strips will attach to the underside of the top edge portion 158, stretch under the rail 116, and again attach to the underside of the top edge portion 158. The strips are not sewn to the top edge portion 158 in order to allow the crib safety net 150 to work with cribs that have slats 120 of varying configurations.

Figure 4:
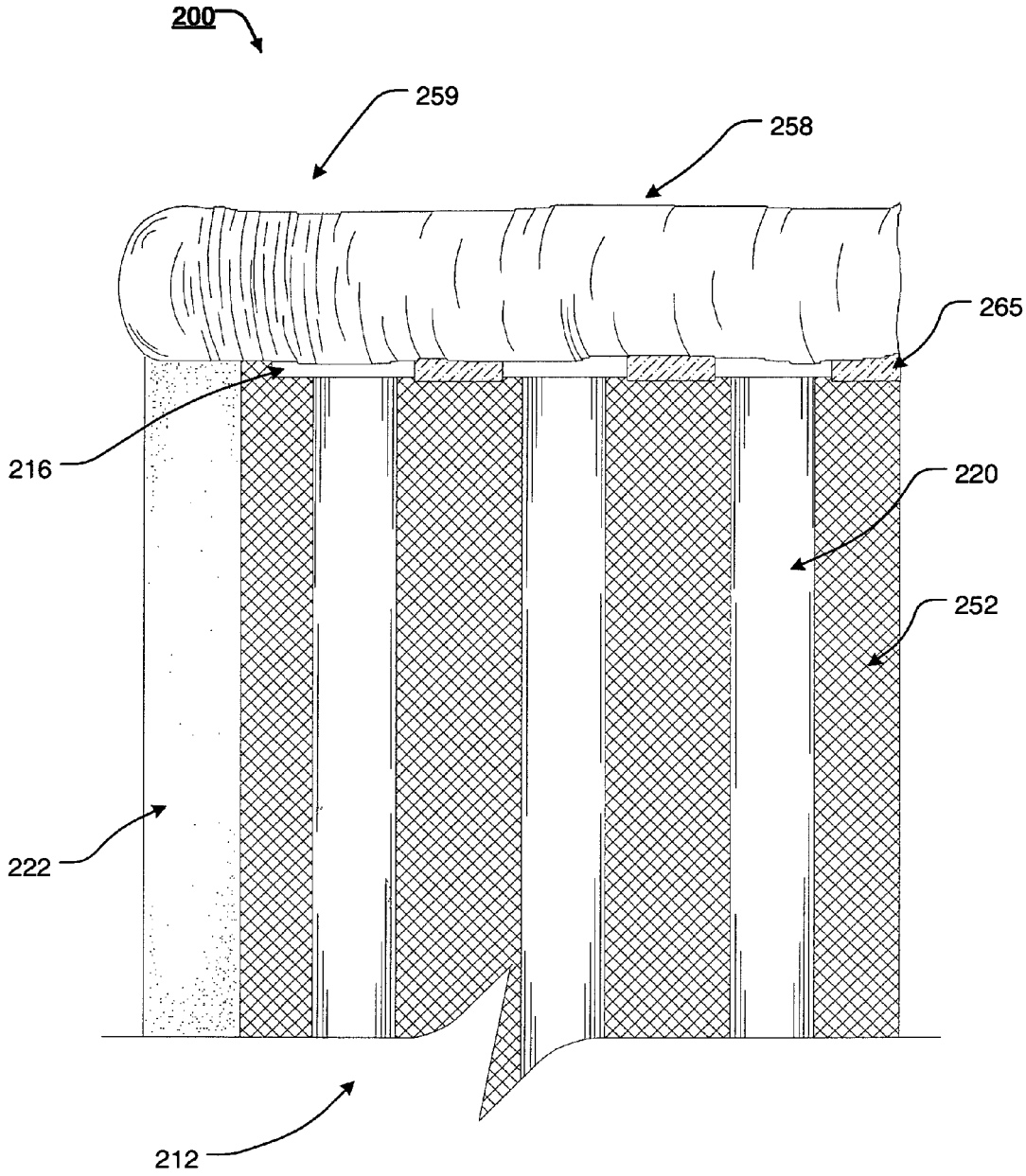
FIG. 4 shows a more detailed front view of a second exemplary embodiment of the top edge portion that highlights how the top edge portion gathers at the point where the side wall opens on a crib with a sliding side wall, when the side wall is in a closed position, according to this invention.

FIG. 4 shows a more detailed front view of a second exemplary embodiment of a crib safety net 250, according to this invention. It should be appreciated that the crib safety net 250 includes similar elements to the crib safety net 150 and operates similarly to the crib safety net 150, as discussed above with respect to FIGS. 1–3. Likewise, it should also be appreciated that the crib safety net 250 operates with a crib 210, wherein the crib 210 includes similar elements to the crib 110 and wherein the crib 210 operates similarly to the crib 110, as discussed above with respect to FIGS. 1–3.

However, as illustrated in FIG. 4, the crib 210 includes at least one sliding side wall 212, wherein the sliding side wall 212 is slideable between a closed position and a lowered position.

Thus, as further illustrated in FIG. 4, the top edge portion 258 of the crib safety net 250 may gather at one or more points where the sliding side wall 212 opens, when the sliding side wall 212 is in a closed position.

As illustrated in FIG. 4, at least a portion of the top edge portion 258 includes an elastic or more elastic portion 259, which allows at least a portion of the top edge portion 258 to gather proximate a corner when the sliding side wall 212 is in a closed position. The elastic portion 259 maintains the top edge portion 258 and the side panel 252 taught when the sliding side wall 212 is in a closed position.

It should be appreciated that in various exemplary embodiments, the elastic or more elastic portion 259 may comprise the top edge portion 258 of at least one of the side panels 252. In these exemplary embodiments, the elastic properties of the top edge portion 258 of at least one of the side panels 252 serve to maintain at least a portion of the top edge portion 258 taught when the sliding side wall 212 is in a closed position. Similarly, the elastic properties of the top edge portion 258 of at least one of the side panels 252 serve to allow at least a portion of the top edge portion 258 to stretch or expand when the sliding side wall 212 is lowered.

Figure 5:
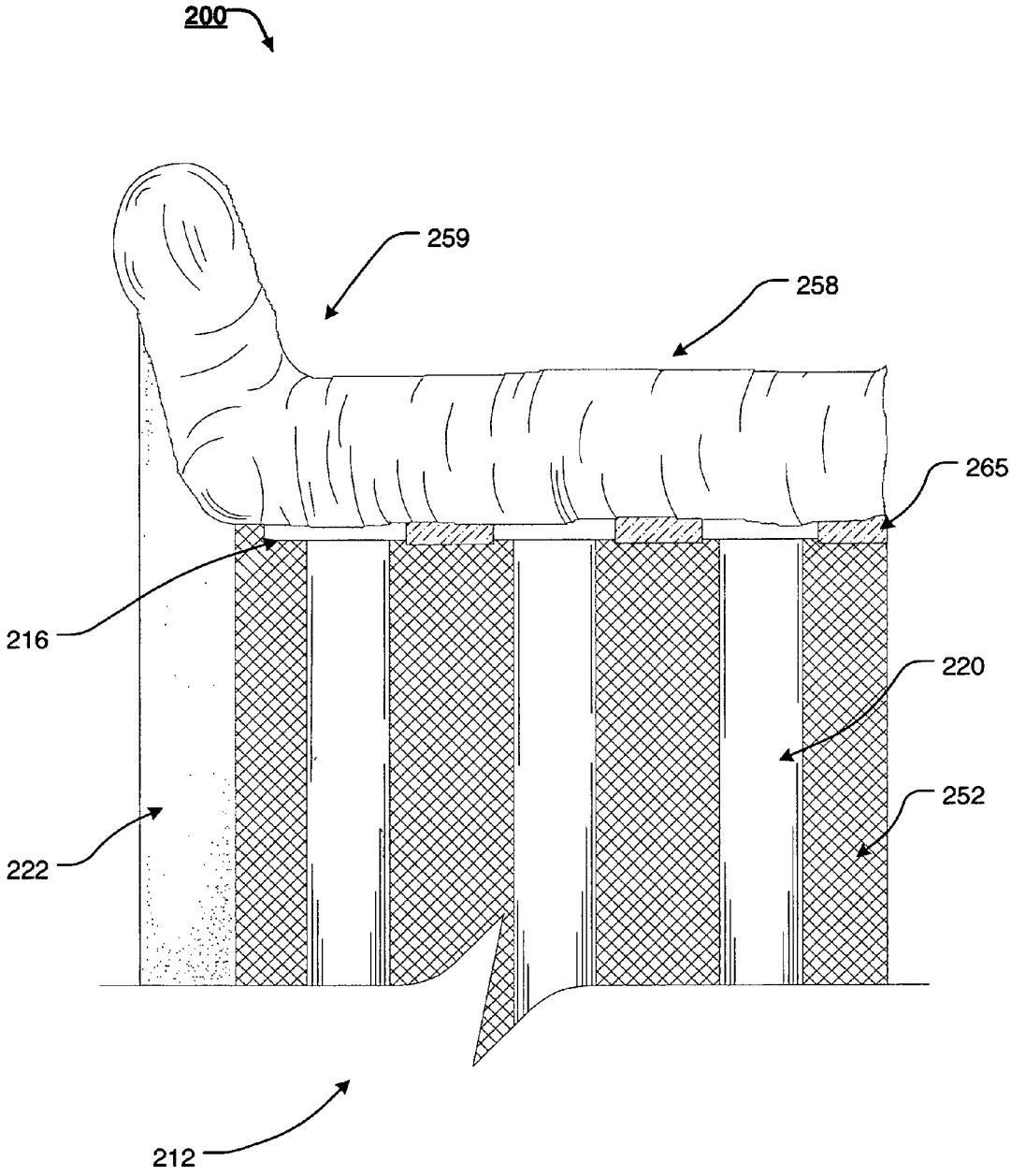
FIG. 5 shows a detailed front view of the second exemplary embodiment of the top edge portion of FIG. 4 on a crib with a sliding side wall, wherein the sliding side wall is in a lowered position and the top edge portion is expand, according to this invention.

FIG. 5 shows a detailed front view of the second exemplary embodiment of the top edge portion 258 of FIG. 4 on a crib 210 with a sliding side wall 212, wherein the sliding side wall 212 is in a lowered position and the top edge portion 258 is expanded, according to this invention. As illustrated in FIG. 5, the elastic portion 259 allows at least a portion of the top edge portion 258 and the side panel 252 to stretch or expand when the sliding side wall 212 is lowered.

Figure 6:
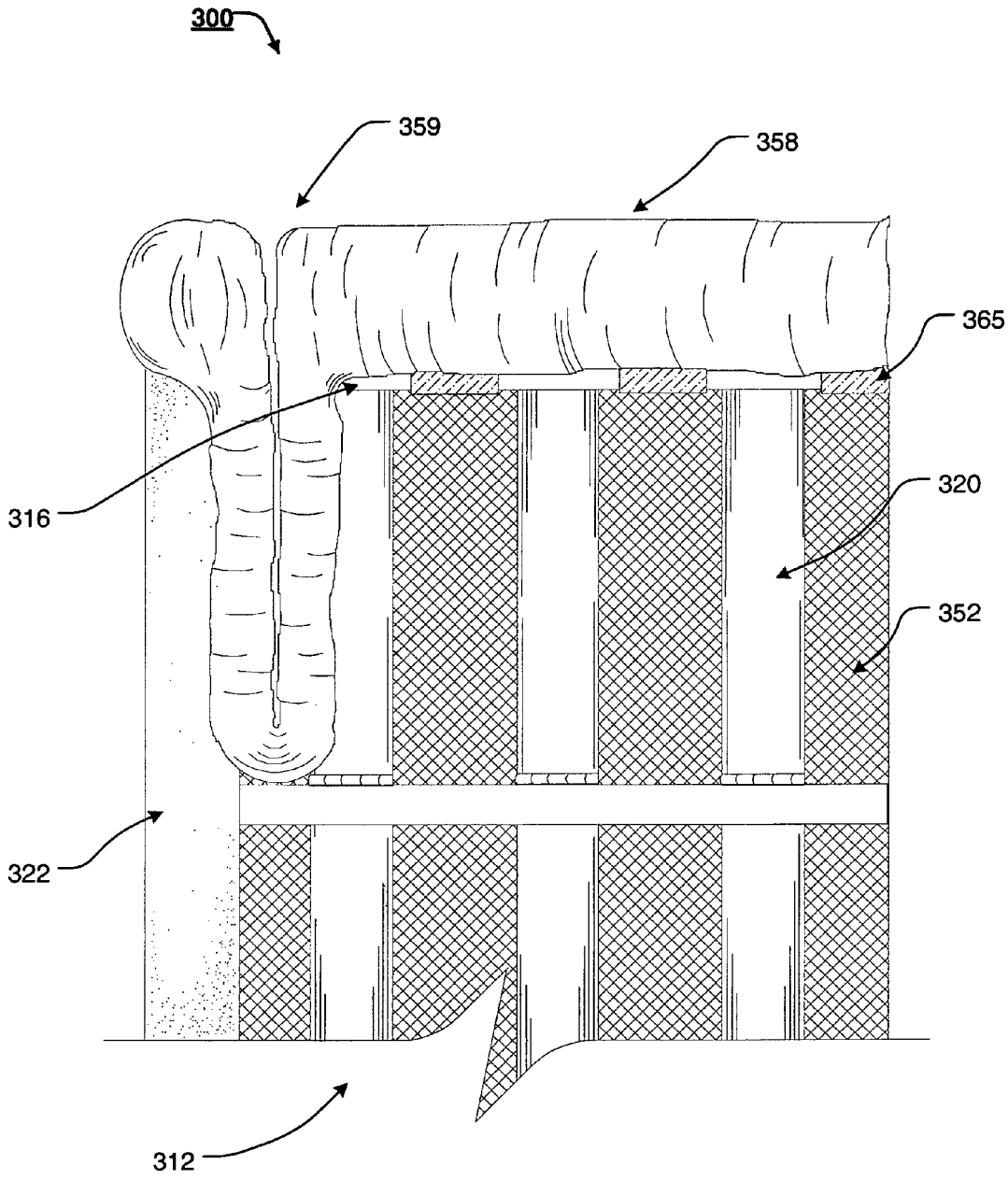
FIG. 6 shows a more detailed front view of a third exemplary embodiment of the top edge portion that highlights how the top edge portion gathers at the point where the side wall opens on a crib with a hinged side wall, when the hinged side wall is in a closed position, according to this invention.

FIG. 6 shows a more detailed front view of a third exemplary embodiment of a crib safety net 350, according to this invention. It should be appreciated that the crib safety net 350 includes similar elements to the crib safety net 150 and operates similarly to the crib safety net 150, as discussed above with respect to FIGS. 1–3. Likewise, it should also be appreciated that the crib safety net 350 operates with a crib 310, wherein the crib 310 includes similar elements to the crib 110 and wherein the crib 310 operates similarly to the crib 110, as discussed above with respect to FIGS. 1–3.

However, as illustrated in FIG. 6, the crib 310 includes at least one hinged side wall 312, wherein the hinged side wall 312 includes at least one hinge means 313. The at least one hinge means 313 allows the at least one hinged side wall 312 to be operable between a closed position and an open position.

Thus, as further illustrated in FIG. 6, the top edge portion 358 of the crib safety net 350 may gather at one or more points where the hinged side wall 312 opens, when the hinged side wall 312 is in a closed position.

As illustrated in FIG. 6, at least a portion of the top edge portion 358 includes an elastic or more elastic portion 359, which allows at least a portion of the top edge portion 358 to gather proximate a corner when the hinged side wall 312 is in a closed position. The elastic portion 359 maintains the top edge portion 358 and the side panel 352 taught when the hinged side wall 312 is in a closed position.

It should be appreciated that in various exemplary embodiments, the elastic or more elastic portion 359 may comprise the top edge portion 358 of at least one of the side panels 352. In these exemplary embodiments, the elastic properties of the top edge portion 358 of at least one of the side panels 352 serve to maintain at least a portion of the top edge portion 358 taught when the hinged side wall 312 is in a closed position. Similarly, the elastic properties of the top edge portion 358 of at least one of the side panels 352 serve to allow at least a portion of the top edge portion 358 to stretch or expand when the hinged side wall 312 is open.

Figure 7:
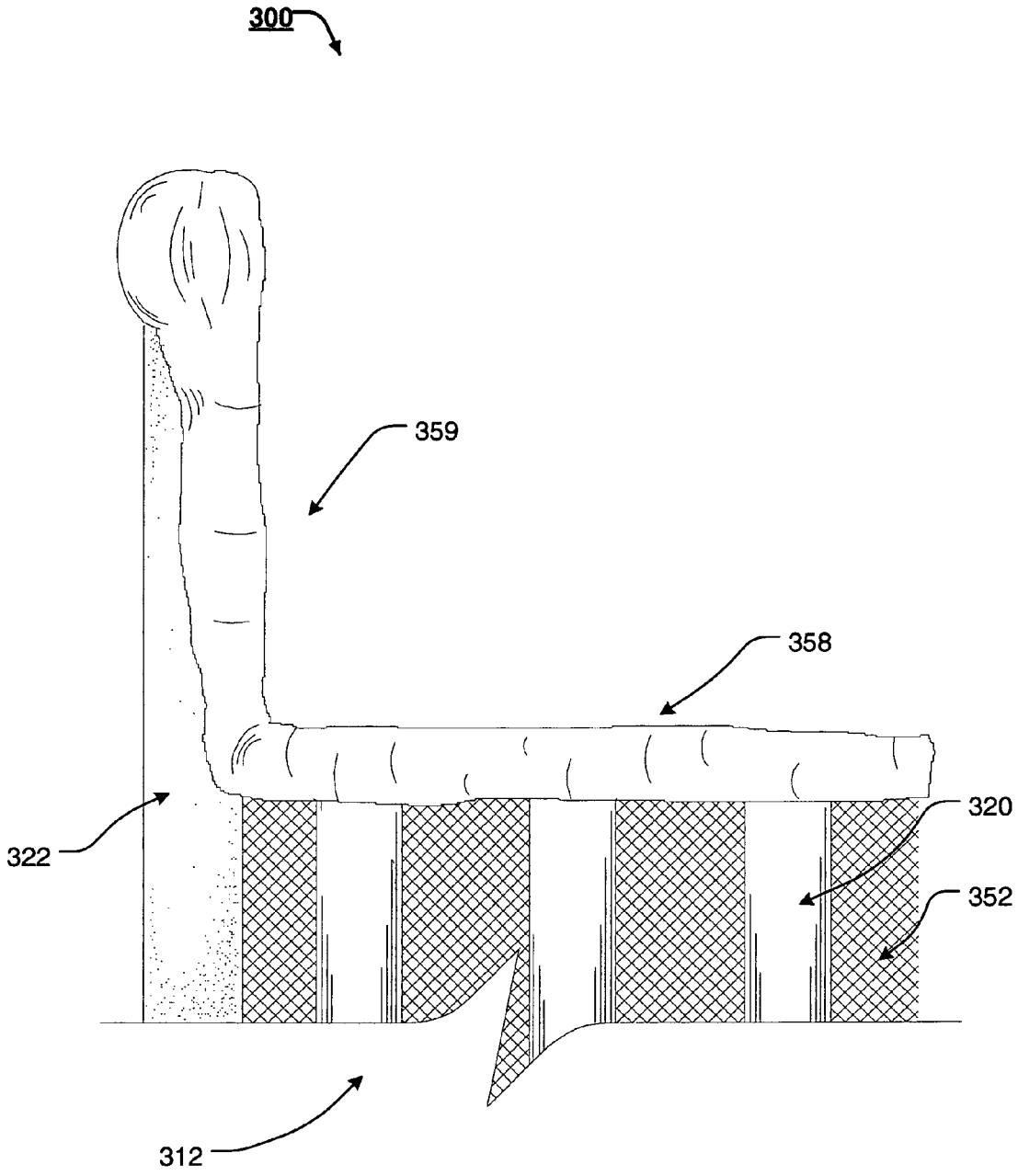
FIG. 7 shows a detailed front view of the third exemplary embodiment of the top edge portion of FIG. 6 on a crib with a hinged side wall; wherein the hinged side wall is in an open position and the top edge portion is expand, according to this invention.

FIG. 7 shows a detailed front view of the third exemplary embodiment of the top edge portion 358 of FIG. 6 on a crib 310 with a hinged side wall 312, wherein the hinged side wall 312 is in a open position and the top edge portion 358 is expand, according to this invention. As illustrated in FIG. 7, the elastic portion 359 allows at least a portion of the top edge portion 358 and the side panel 352 to stretch or expand when the hinged side wall 312 is open.

While this invention has been described in conjunction with the exemplary embodiments outlined above, it is evident that many alternatives, modifications, and variations will be apparent to those skilled in the art. For example, the embodiments of this invention have been described with reference to the exemplary crib and crib safety taking a generally rectangular shape. However, it should be appreciated that the crib safety net of this invention may be utilized in various other shapes and sizes, provided that the general shape and size of the crib safety net is substantially similar to the general shape and size of the interior of the crib or other enclosure in which it is to be used.

Additionally, the embodiments of this invention have been described with reference to the exemplary crib safety net comprising two opposing side panels and the two opposing end panels. However, it should be appreciated that the crib safety net of this invention may comprise one or more side panels coupled relative to each other, provided that the general shape, size, and number of side panels is substantially similar to the general shape, size, and number of walls of the crib or other enclosure in which it is to be used.

Such adaptations and modifications should and are intended to be comprehended within the meaning and range of equivalents of the disclosed exemplary embodiments.

It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. A crib safety net, which is securable to an open-top interior space of a crib, wherein the crib comprises side walls and a support surface defining an open-top crib interior space, and wherein the side walls include a top rail, comprising:

one or more side panels coupled relative to each other, wherein the side panels from vertical panels of the crib safety net, wherein the side panels are capable of substantially covering the side walls of the open-top crib interior space, and wherein the side panels each include a top edge portion, wherein each top edge portion is of a sufficient dimension to at least partially cover a top rail of the side walls of the crib;

a bottom panel substantially perpendicularly coupled relative to the side panels, wherein the bottom panel forms a horizontal panel of the crib safety net, wherein the bottom panel is capable of substantially covering the support surface of the open-top crib interior space, and wherein the bottom panel is capable of being at least partially covered by a crib mattress; and a compartment constructed within at least a portion of at least one of the side panels, wherein the compartment is constructed so as to allow at least a portion of a bumper pad to be held within the compartment.

2. The crib safety net of claim 1, wherein the one or more side panels comprise two opposing side panels and two opposing end panels.

3. The crib safety net of claim 1, wherein the one or more side panels are sewn, fused, attached, or otherwise coupled to each other.

4. The crib safety net of claim 1, wherein the one or more side panels are formed of one, substantially continuous loop of material.

5. The crib safety net of claim 1, wherein the one or more side panels are sewn, fused, attached, or otherwise coupled to the bottom panel.

6. The crib safety net of claim 1, wherein the one or more side panels and the bottom panel are formed of ones substantially continuous portion of material.

7. The crib safety net of claim 1, wherein the side panels and/or bottom panel comprise an open mesh weave having a mesh size, which is capable of preventing a baby's arm, leg, hand, or finger from passing through the mesh.

8. The crib safety net of claim 1, wherein the side panels and/or bottom panel comprise multiple materials.

9. The crib safety net of claim 1, wherein the top edge portion comprises an elastic or stretchable material.

10. The crib safety net of claim 1, wherein the top edge portion comprises a non-elastic or non-stretchable material.

11. The crib safety net of claim 1, wherein the top edge portion comprises a padded portion that is permanently or removably attached to the top edge portion.

12. The crib safety net of claim 1, wherein the top edge portion of each of the side panels is capable of being releasably secured, via a safety net attachment means, along a portion of a rail of the crib.

13. The crib safety net of claim 12, wherein the safety net attachment means comprises a hook and loop fastener, Velcro, male/female snap-release buckles, zippers, buttons, snaps, or other equivalent fastening, closure, or attachment means.

14. The crib safety net of claim 1, wherein the compartment is positioned substantially above the crib mattress.

15. The crib safety net of claim 1, wherein at least a portion of the compartment is formed of the same material as the side panels of the crib safety net.

16. The crib safety net of claim 1, wherein at least a portion of the compartment is formed of a material that is different from side panels of the crib safety net.

17. The crib safety net of claim 1, wherein at least a portion of the top edge portion includes an elastic portion, which allows at least a portion of the top edge portion to gather when a sliding side wall of the crib is in a closed position and allow at least a portion of the top edge portion to stretch or expand when the sliding side wall is lowered.

18. The crib safety net of claim 1, wherein at least a portion of the top edge portion includes an elastic portion, which allows at least a portion of the top edge portion to gather when a hinged side wall of the crib is in a closed position and allow at least a portion of the top edge portion to stretch or expand when the hinged side wall is opened.

19. A crib safety net, which is securable to an open-top interior space of a crib, wherein the crib comprises side walls and a support surface defining an open-top crib interior space, and wherein the side walls include a top rail, comprising:

one or more side panels coupled relative to each other, wherein the side panels form vertical panels of the crib safety net, wherein the side panels are capable of substantially covering the side walls of the open-top crib interior space, and wherein the side panels each include a top edge portion, wherein each top edge portion is of a sufficient dimension to at least partially cover a top rail of the side walls of the crib, and wherein the top edge portion of each of the side panels is capable of being releasably secured, via a safety net attachment means, along a portion of a rail of the crib;

a padded portion attached to the top edge portion;

a bottom panel substantially perpendicularly coupled relative to the side panels, wherein the bottom panel forms a horizontal panel of the crib safety net, wherein the bottom panel is capable of substantially covering the support surface of the open-top crib interior space, and wherein the bottom panel is capable of being at least partially covered by a crib mass; and a compartment constructed within at least a portion of at least one of the side panels, wherein the compartment is constructed so as to allow at least a portion of a bumper pad to be held within the compartment.

20. The crib safety net of claim 19, wherein the safety net attachment means comprises a hook and loop fastener, male/female snap-release buckles, zippers, buttons, snaps, or other equivalent fastening, closure, or attachment means.

21. A crib safety net, which is securable to an open-top interior space of a crib, wherein the crib comprises side walls and a support surface defining an open-top crib interior space, and wherein the side walls include a top rail, comprising:

one or more side panels coupled relative to each other, wherein the side panels form vertical panels of the crib safety net, wherein the side panels are capable of substantially covering the side walls of the open-top crib interior space, and wherein the side panels each include a top edge portion, wherein each top edge portion is of a sufficient dimension to at least partially cover a top rail of the side walls of the crib, and wherein at least a portion of the top edge portion includes an elastic portion, which allows at least a portion of the top edge portion to gather when a side wall of the crib is in a closed position and allow at least a portion of the top edge portion to stretch or expand when the side wall is lowered or opened;

a bottom panel substantially perpendicularly coupled relative to the side panels, wherein the bottom panel forms a horizontal panel of the crib safety net, wherein the bottom panel is capable of substantially covering the support surface of the open-top crib interior space, and wherein the bottom panel is capable of being at least partially covered by a crib mattress; and a compartment constructed within at least a portion of at least one of the side panels, wherein the compartment is constructed so as to allow at least a portion of a bumper pad to be held within the compartment.

* * * * *